United States Patent [19]

Ishii

[11] Patent Number: 4,749,987

[45] Date of Patent: Jun. 7, 1988

[54] ANALOG FIRE DETECTOR AND ANALOG FIRE ALARM SYSTEM USING THE SAME

[75] Inventor: Hiromitsu Ishii, Chiba, Japan

[73] Assignee: Hochiki Corporation, Tokyo, Japan

[21] Appl. No.: 848,726

[22] Filed: Apr. 4, 1986

[30] Foreign Application Priority Data

Apr. 9, 1985 [JP] Japan ..... 60-75195

[51] Int. Cl.[4] ..... G08B 17/00

[52] U.S. Cl. ..... 340/587; 340/511; 364/178

[58] Field of Search ..... 340/587, 578, 511; 364/178, 551, 557

[56] References Cited

U.S. PATENT DOCUMENTS 4,644,331 2/1987 Matsushita et al. ..... 340/587

*Primary Examiner*—Joseph A. Orsino
*Assistant Examiner*—Thomas J. Mullen, Jr.
*Attorney, Agent, or Firm*—Lackenbach Siegel Marzullo & Aronson

[57] ABSTRACT

An analog fire detector which comprises sensor means for detecting, in analog form, one or more kinds of quantity of state which change due to fire; a sampling means for sampling the detection outputs from the sensor means with a predetermined period; and fire determining means which predicts future fire data changes from the sampling data and generates a fire determination output signal when the prediction data satisfies predetermined fire conditions. The invention also provides an analog fire alarm system which comprises a central signal station; a plurality of on-off type fire detectors connected to a pair of power supply/signal lines connected to said central signal station in such a manner that the signal lines are short-circuited into low impedance when the value of a quantity of state changed due to a fire exceeds a threshold value; and an intelligent fire detector installed in specific areas, where the signal lines are extended, such as an important supervisory area or an area where a false alarm is liable to occur, and adapted to short-circuit the signal lines into low impedance when a predicted value of a future quantity of state changing due to a fire satisfies predetermined fire conditions; such intelligent fire detector being the analog fire detector mentioned above.

22 Claims, 9 Drawing Sheets

ANALOG FIRE DETECTOR AND ANALOG FIRE ALARM SYSTEM USING THE SAME

FIELD OF THE INVENTION AND RELATED ART

This invention relates to an analog fire detector and a fire alarm system using the same which is adapted to predict future changes of fire data on the basis of analog signals, such a temperature or a smoke density caused by a fire, to make a fire determination. Conventional fire alarm systems emply so-called on-off type fire detectors which are adapted to close their contacts when they detect a fire and transmit a fire signal to a central signal station. However, recently, there has been proposed an analog type fire alarm system in which, instead of using the on-off type fire detectors, analog sensors are used to detect a temperature or smoke density caused by a fire, the detection data is transmitted to a central signal station without being subjected to fire determination at the detectors, and the fire determination is made, based on the analog detection data, by the program processing of a CPU included in the central signal station.

In this analog type fire alarm system, since the fire determination is carried out by the program processing of a CPU in the central signal station, false alarming can be minimized and early fire detection is enabled, as compared with the conventional fire alarm system using the on-off type fire detectors in which fire determination is carried out by the circuits in the detectors.

However, this analog type fire alarm system has some problems. Stated more particularly, although the analog type fire alarm system which makes fire determination at the central signal station can assure accurate and quick fire determination by the CPU of the central signal station, it needs polling operation for calling the analog sensors in sequence from the central signal station to allow each in turn to transmit the analog data on hand. Furthermore, since this analog type fire alarm system cannot be incorporated in the conventional fire alarm system using the on-off type fire detectors, it cannot be applied to an already installed fire alarm system.

Further, it is to be noted that, in general, such sites that need especially accurate and rapid fire determination by the analog type fire alarm system are limited. In other words, it is not necessary to install analog sensors in a site where fire can never occur or in a site where there is apparently no fear of starting of a fire, and it is not economical to install the analog sensors at such sites for carrying out accurate fire determination. In those sites, the conventional on-off type fire detectors are sufficient to supervise the areas. However, when it is required to partly adopt the analog systm, the system already installed should be removed and the entire system should be completely replaced with a new analog fire alarm system, because the analog system cannot simply be added to the conventional system. This is a serious problem in a situation where a fire alarm system using the on-off type fire detectors prevails.

SUMMARY OF THE INVENTION

The present invention has been achieved with a view to obviating the problems as mentioned above, and it is an object of the present invention to provide an analog fire detector which itself is capable of effecting accurate and quick fire determination and an analog fire alarm system which is capable of carrying out fire determination in the analog form at an important area or an area where a false alarming is liable to occur, while allowing the conventional fire alarm system using on-off type fire detectors also to be utilized.

In order to attain these objects, the analog fire detector of the present invention comprises a sensor means for detecting, in the analog form, one or more kinds and quantities of state, which will change due to a fire; a sampling means for sampling the detection outputs from the sensor means with a predetermined period; and a fire determining means which predicts future fire data changes from the sampling data and generates a fire determination output when the prediction data satisfies predetermined fire conditions. The analog fire alarm system of the present invention comprises a central signal station; a plurality of on-off type fire detectors connected to a pair of power supply/signal lines derived from said central signal station in such a manner that the signal lines are short-circuited into low impedance when the value of a quantity of state changed due to a fire exceeds a threshold value; and an intelligent fire detector installed in specific areas, where the signal lines are extended, such as an important supervisory area or an area where a false alarming is liable to occur and adapted to short-circuit said lines into low impedance when a predicted value of a future quantity of state changing due to a fire satisfies predetermined fire conditions; said intelligent fire detector being the analog fire detector which further includes a switching circuit for short-circuiting the power supply/signal lines into low impedance on the basis of the fire determination output from said fire determining means.

DETAILED DESCRIPTION OF PREFERRED EMBODIMENT

Figure 1:
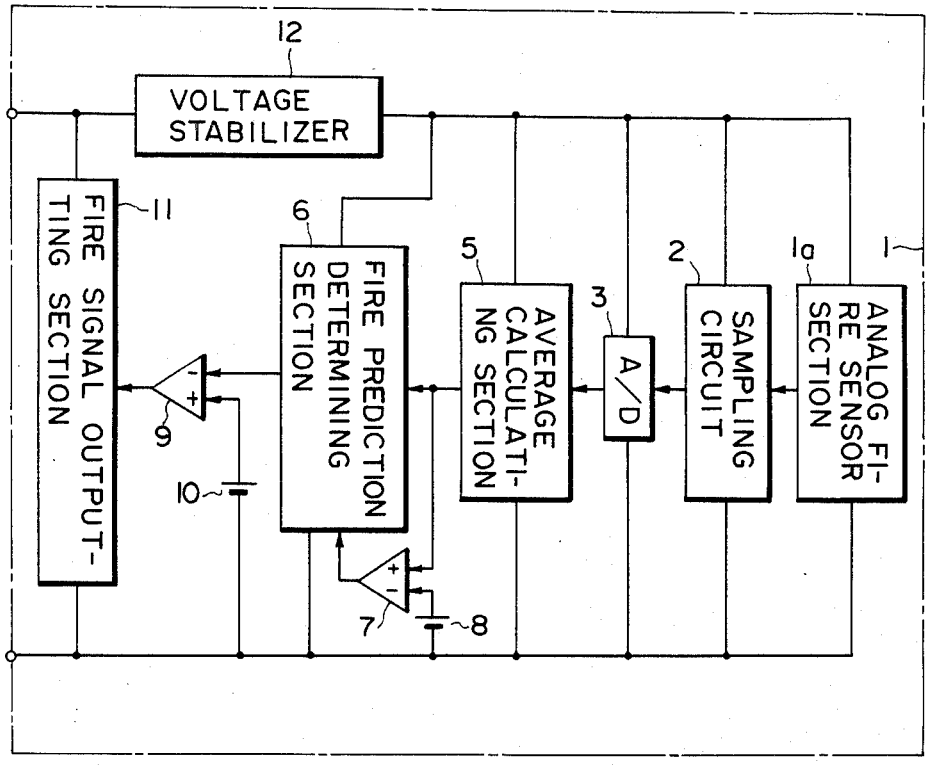
FIG. 1 is a block diagram of an analog fire detector employable in a first embodiment of the present invention.
Figure 3:
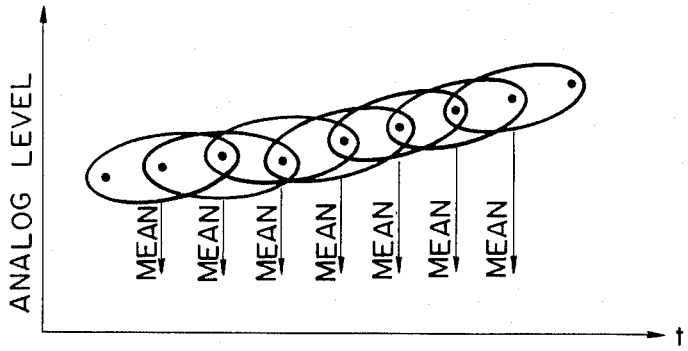
FIG. 3 is an explanatory view showing average calculation of data.

FIG. 1 illustrates a block diagram of one form of analog fire detector of the present invention.

This analog fire detector 1 is of the so-called intelligent type. The arrangement of the intelligent fire detector 1 will be first described. A analog sensor section 12 detects, in the analog form, a change in the quantity of state, such as a temperature, a smoke density, a CO gas concentration, etc. caused by a fire. A sampling circuit 2 samples, with a predetermined period, the analog detection signals from the analog sensor section 1*a*. An A/D converter 3 which converts the sampling data into digital data. The fire data converted into the digital data by the A/D converter 3 is supplied to an average calculating section 5.

Figure 2:
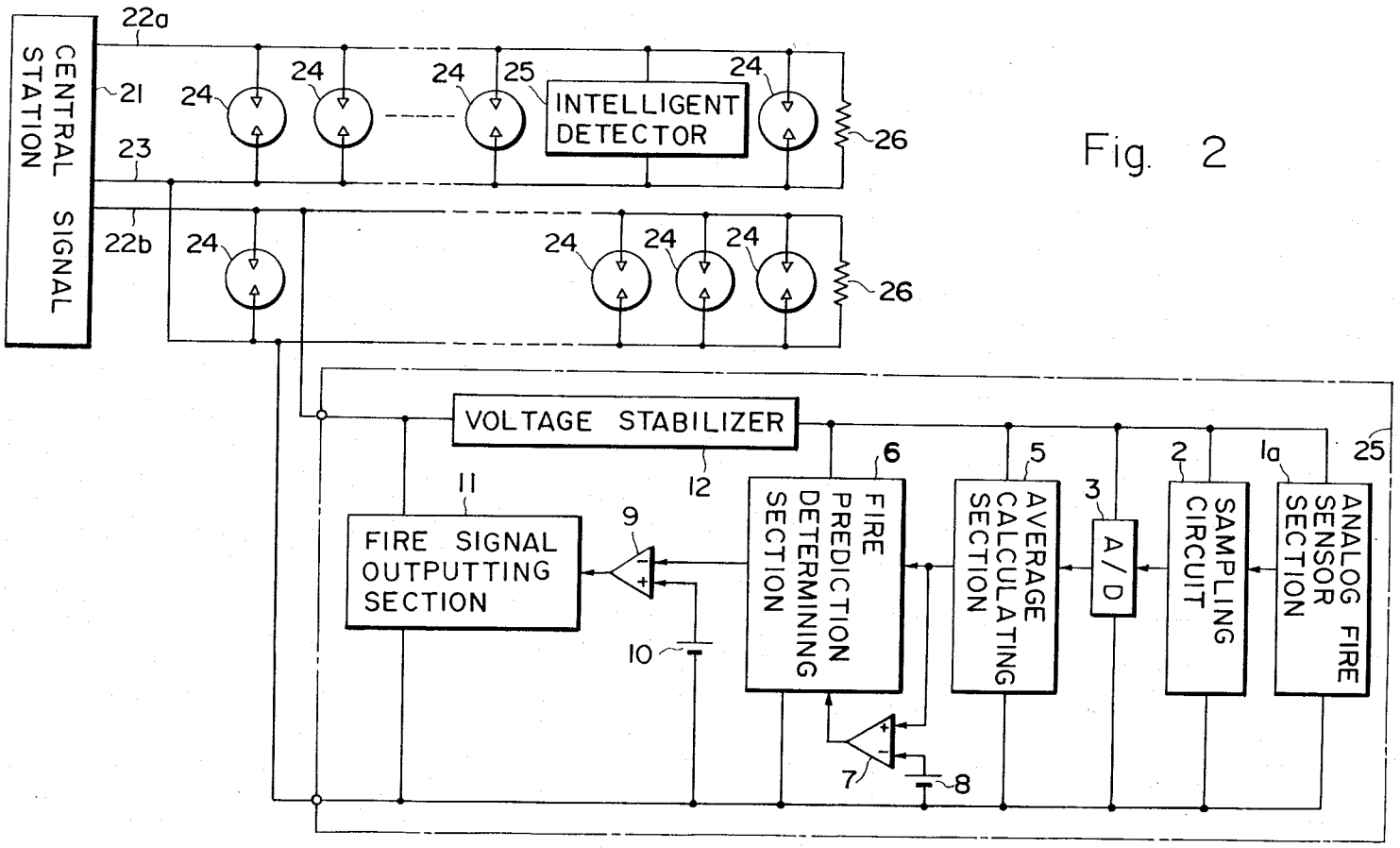
FIG. 2 is a block diagram of an analog fire alarm system employing the detector of FIG. 1.

This average calculating section 5 carries out moving average calculation and simple average calculation of the sampling data. More specifically, as shown in FIG. 2, average values (MEAN) of these sequentially obtained sampling data are sequentially calculated and then simple average values of six data obtained by the moving average calculation are calculated to provide data to be transmitted to the central signal station.

This average calculation processing comprising the moving average calculation and the simple average calculation, functions as a low pass digital filter for eliminating higher harmonic components generated by fundamental frequency components inherent in fire temperature or smoke producing the analog detection signals. By this low pass digital filter, the original signal can be faithfully reproduced. Further it will be enough for the average calculating section 5 to carry the average calculation using only by the moving average because the digital filter can be comprised only in the moving average calculation.

As the analog detection signals are subjected to sampling, the probability that pulse noises will be taken as sampling data is reduced. In addition, even if the pulse noises are taken in the sampling data, sufficient noise suppression can be effected by the average calculation.

In 1 a fire prediction determining section 6 initiates the prediction calculation, on the basis of a H-level output from a comparator 7, when a predetermined calculation starting level set by a reference voltage source 8 of the comparator 7, which is input with an output from the average calculating section 5, is exceeded. Further, fire prediction determining section 6 includes a memory function in which the renewed sensor data from the average calculating section 5 is stored in order to carry the calculation. The prediction data from the fire prediction determining section 6 is further supplied to a comparator 9. In the comparator 9, a threshold value for determining the prediction data as being a fire is set by a reference voltage source 10. When the prediction data exceeds the threshold level determined by the reference voltage source 10, a fire determination output is generated as a H-level output of the comparator 9. The output from the fire prediction determining section 6 is supplied to a fire signal outputting section 11 and the fire signal outputting section 11 turns on a switching element based on the fire determination output so as to transmit a fire signal by allowing an alarming current to flow through the signal line derived from the central signal station. The fire signal outputting section 11 may alternatively be of a type which transmits a fire signal in response to polling from the central signal station. A voltage stabilizer 12 is supplied with power from the central signal station and provides to apply a constant voltage to the respective circuits.

FIG. 2 is a block diagram of an entire analog fire information system according to the present invention.

The arrangement in FIG. 2 will be first described. A pair of power supply/signal lines comprised of a signal line 22*a*, 22*b* and a common line 23 are derived from a central signal station 21 for each supervisory region, for example a supervisory region of every floor of a building.

Between the signal line 22*a* and the common line 23, a plurality of on-off type fire detectors 24 are connected in parallel with each other for each of the supervisory regions. A terminal resistor 26 is connected at the end of the signal line. Further, at an important site such as a computer room etc. or a site such as a cooking room where an erroneous alarming is liable to occur and which are included in the region where the siganl line 22*a* is provided, an intelligent fire detector 25 is connected between the signal line 22*a* and the common line 23 in parallel in a manner similar to those of the on-off type fire detectors 24. Such connections of the on-off type fire detector 24 and the intelligent fire detector 25 are also made for the signal line 22*b*.

The on-off type fire detector 24 closes its switching contacts to short-circuit the signal line 22*a* or 22*b* and the common line 23 into low impedance when a detection signal of a change of the physical phenomena caused by a fire, such as a temperature or a smoke density, exceeds the fixed threshold value. The central signal station 21 detects, upon the switching-on of the on-off type fire detector 24, an increase in the current flowing between the signal line 22*a*, 22*b* and the common line 23 and gives a fire alarm.

On the other hand,, the intelligent fire detector 25 may be substantially the same as the analog fire detector 1 of FIG. 1 but includes a CPU therein, as will be described in detail later, for determining as to whether it is a fire or not and for short-circuiting the signal lines 22*a*, 22*b* and the common line 23 into low impedance, when it is determined as a fire, by the operation of a switching circuit as in the on-off type fire detectors 24 so as to transmit a fire signal to the central signal station 21. More specifically, a switching circuit in the fire signal outputting section 11 has a function as an interface for connecting the intelligent fire detector 25 to the signal line of the conventional fire alarm system. The switching fire outputting action 11 switches an SCR or the like built therein, when a fire signal is obtained from the fire prediction determining section 6, to short-circuit the pair of power supply/signal lines derived from the central signal station 21 into low impedance.

Figure 4:
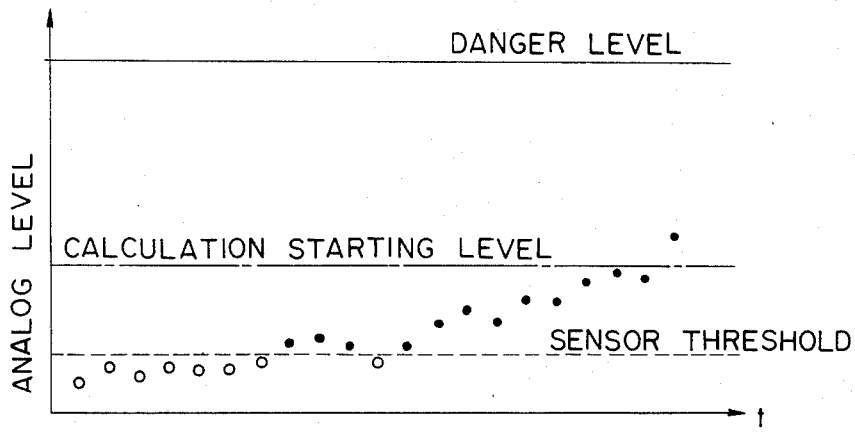
FIG. 4 is an explanatory view showing the relationship between the calculation starting level of the sensor and the danger level used for fire determination by the central signal station.

FIG. 4 shows the relationship between the threshold levels used for the fire determinations and the analog level. For the fire determination, a calculation starting level for starting the predictive calculation by the functional approximation and a danger level for obtaining, on the basis of the predictive calculation result, a time left before it reaches a fire, are set. The danger level is determined on the basis of a temperature or smoke density of surrounding conditions in which human beings cannot exist.

Figure 5:
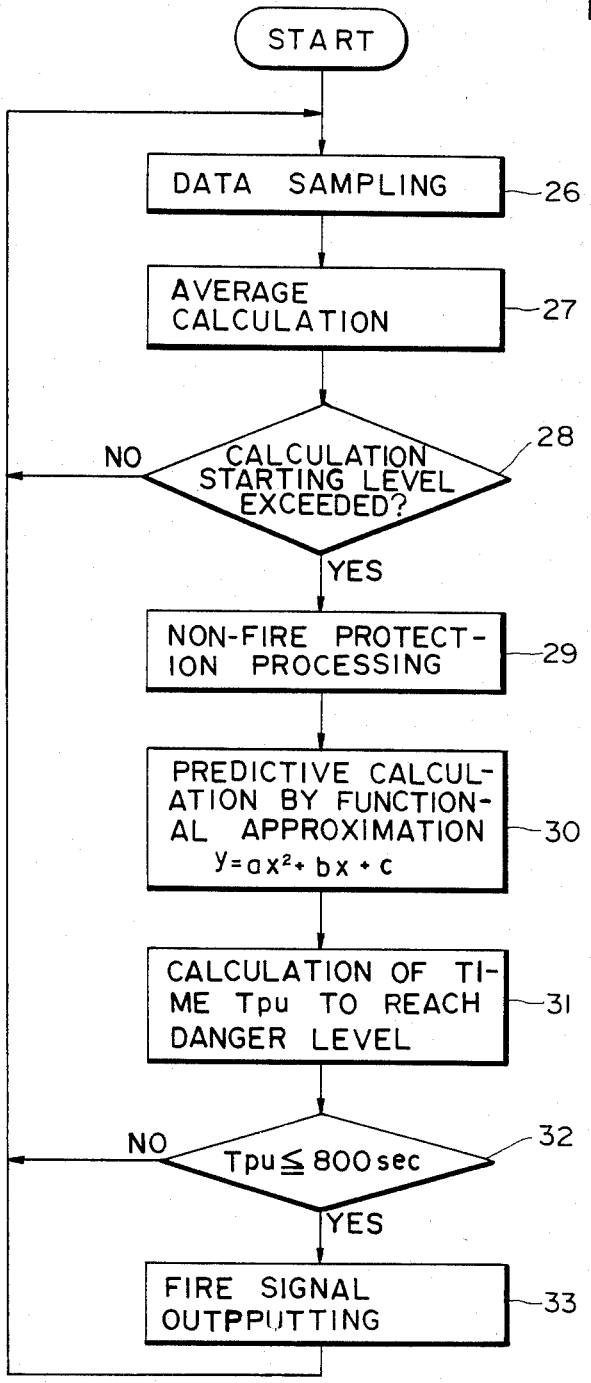
FIG. 5 is a flowchart of the fire determination processing.

FIG. 5 is a flowchart of one example of the fire determination processing carried out by the fire prediction determining section 6 provided in the intelligent fire detector 25. In this flowchart an example of the predictive calculation processing by the functional approximation is exemplarily shown.

The operation of the fire predictive calculation processing are as follows:

a. elimination of higher harmonics by average calculation b. protecting processing for non-fire alarming c. predictive calculation of a fire according to functional approximation.

First, at block 26, the detection data from the analog sensor 1*a* is sampled by the sampling circuit 2 and subjected to average calculation at block 27. At block 28, it is checked if the latest average data exceeds the calculation starting level, that is, if the H-level output is produced comparator 7, as shown in FIG. 4.

The fire prediction determining section 6 stores sequentially sensor data, for example, 20 sensor data LD1 to LD20 in the above mentioned storing function for calculation processing by functional approximation. If the received latest sensor data LD20 exceeds the calculation starting level, the process proceeds to block 29 for non-fire protecting processing.

Figure 6:
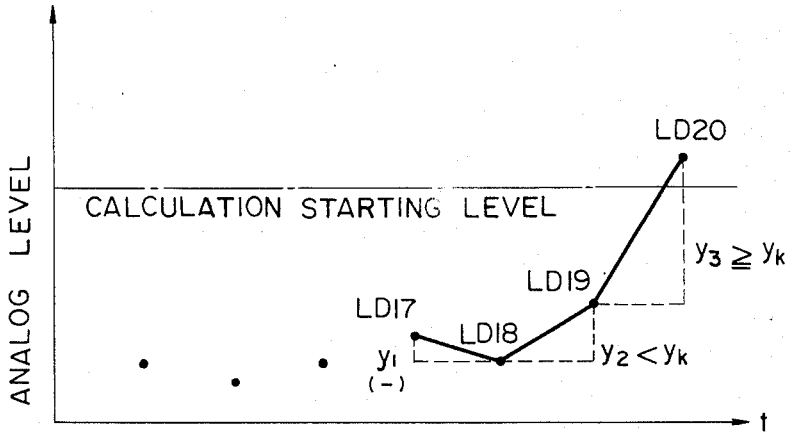
FIGS. 6 and 7 are explanatory views showing the non-fire protection processing.

FIG. 6 shows slopes y1 to y3 as detecting examples. In this case, slope y1 is negative and slopes y2 and y3 are positive. As to the positive slopes y2 and y3, it is checked whether they are larger than a predetermined slope yk or not and the number n of the slopes larger than the slope yk is counted. When the number n of the slopes larger than the slope yk exceeds two as shown in FIG. 6, it is determined that there is a possibility of a fire and the process proceeds to the following step 30 so as to initiate the predictive calculation by the functional approximation.

Figure 7:
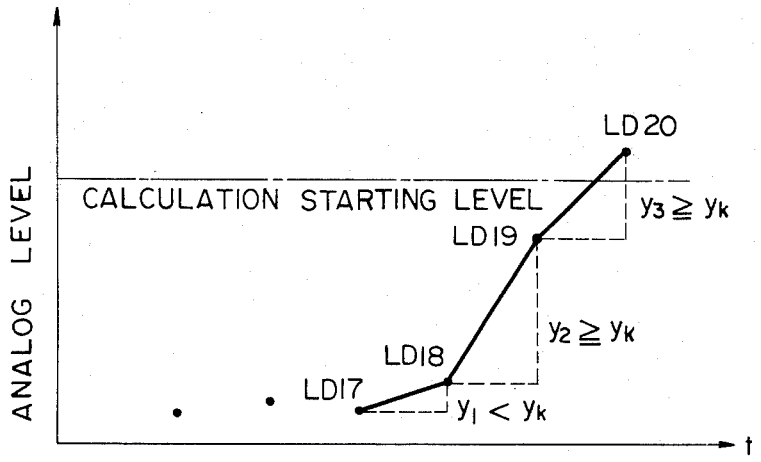

On the other hand, as shown in FIG. 7, when the number n of the slopes largher than the slope yk is smaller than two, it is determined that the change of the data is due to smoke of cigarette etc. and no predictive calculation by the functional approximation is carried out.

The data passed through the non-fire protection processing at block 29 is subjected to the predictive calculation at block 30.

Figure 8:
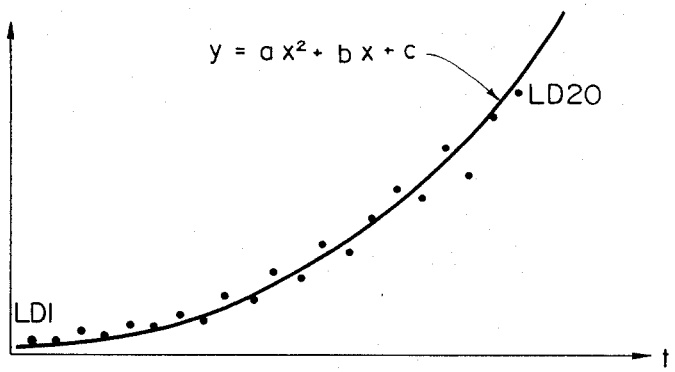
FIG. 8 is an explanatory view of the quadratic functional prediction calculation.

In this predictive calculation, a change with time of a temperature or smoke density due to a fire is approximated by:

$$y=ax^2+bx+c$$

and there will be obtained the values of the coefficients a, b and c of quadratic function shown in FIG. 8 which are provided by the 20 data LD1 to LD20 obtained by the average calculation. The coefficients a, b and c are obtained by solving a set of simultaneous equations using determinants by the method of least squares according to the Gauss-Jordan method.

Figure 9:
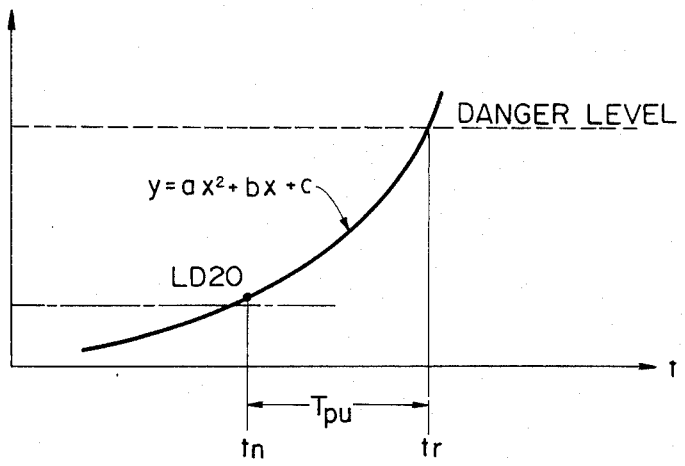
FIG. 9 is an explanatory view showing the time required to reach a danger level.

Once the coefficients a, b and c are obtained, a locus of future data changes can be determined as shown in FIG. 9.

Therefore, at the following block 31, a time tr which is a time required to reach the danger level is obtained on the basis of the quadratic function of FIG. 8 and a predicted time Tpu left at the present time tn to reach the danger level is calculated.

At a decision block 32, since the shorter the time left to reach the danger level the higher is the possibility of a real fire, the time is compared, for example, with a threshold time 800 sec, and if the time is shorter than 800 sec, it is determined as being a fire and fire alarm is given at block 33.

The predictive calculation processing is carried out similarly to the example of FIG. 1. In this embodiment, quadratic function approximation is employed, but linear function approximation can be also emplyed.

Figure 10:
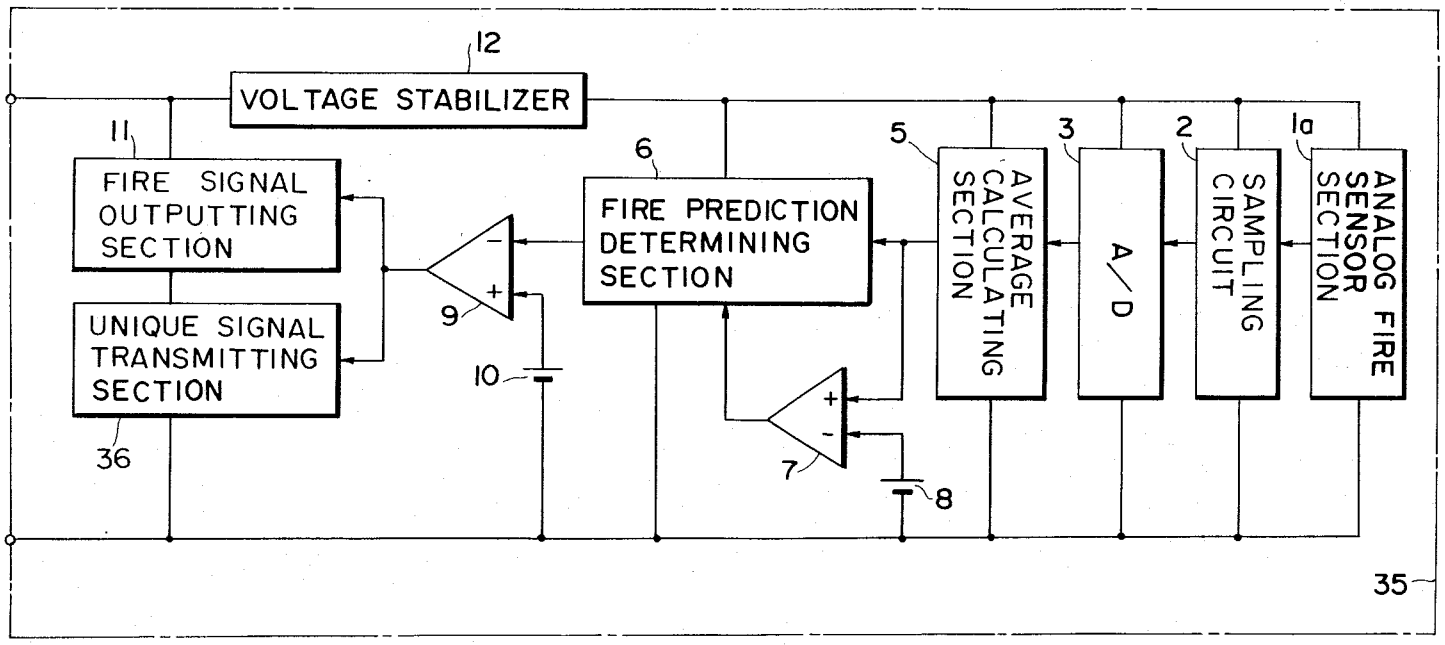
FIG. 10 is a block diagram of a second form of analog fire detector employable in the present invention.

FIG. 10 is a block diagram of another form of the intelligent fire detector employable in the present invention. In FIG. 2, the intelligent fire detector 21 simply outputs a fire detection signal, in the on-off form, to the central signal station, whereas in FIG. 10, a unique signal representing an address of the intelligent fire detector 35 may be transmitted.

The analog sensor section 19, the fire prediction determining section 6, the fire signal outputting section 11 and the voltage stabilizer 12 are substantially the same as those of FIG. 2, but a unique signal transmitting section 36 is additionally connected in series with the fire signal outputting section 11. The fire determination output from the fire prediction determining section 6 operates not only the fire signal outputting section 11 but also the unique signal transmitting section 36, simultaneously. The unique signal transmitting section 36 transmits a unique signal having a frequency preliminarily allotted or an address signal as a code signal to the central signal station. The central signal station receives the fire detection signal transmitted through the fire signal outputting section 11 and simultaneously receives the unique signal to display a fire starting region.

Figure 11:
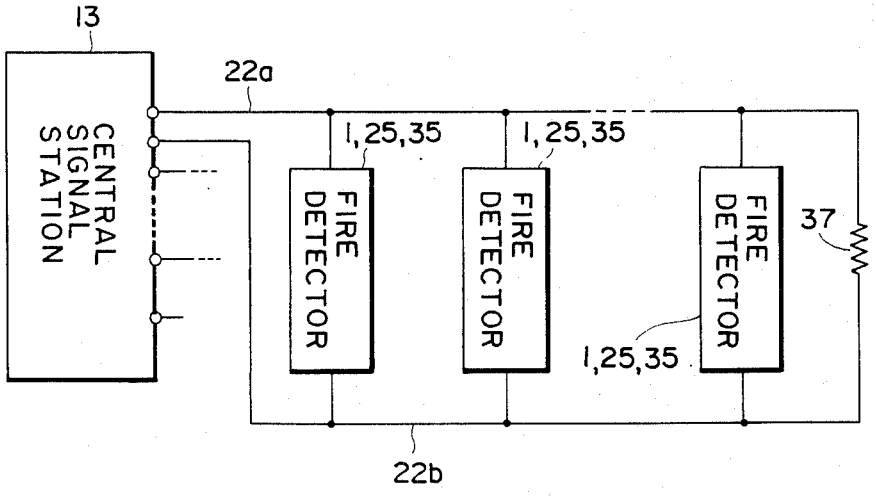
FIG. 11 is block diagram of a second form of analog fire alarm system embodying the present invention.

FIG. 11 is an analog fire alarm system in which all the fire detectors connected between the power supply/signal lines 22*a*, 22*b* are analog fire detectors 1, 25, 35 of the present invention. In the figure, 37 is a terminal resistor for detecting possible disconnection of the lines.

Figure 12:
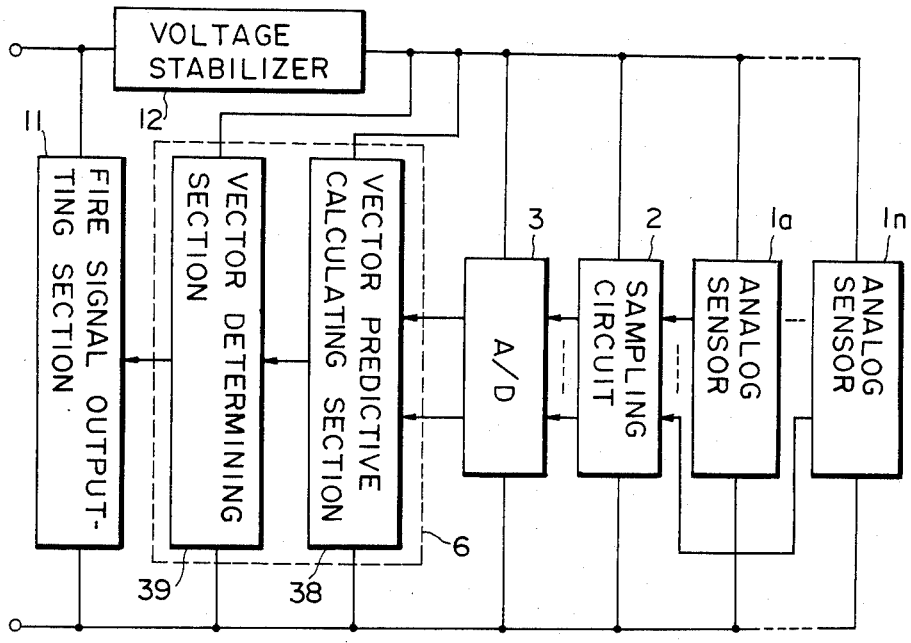
FIG. 12 is a third form of analog fire detector employable in the present invention.

FIG. 12 is a block diagram showing a still further form of analog fire detector. In this form of analog fire detector, fire prediction determination is carried out on the basis of changes of different physical phenomena caused by a fire.

In FIG. 12, 1*a* to 1*n* are analog sensors each adapted to detect different changes in quantities of states due to a fire, for example, a temperature, a smoke density and, a CO gas concentration, respectively. The detection outputs from the analog sensors 1*a* to 1*n* are supplied to a sampling circuit 2, converted into digital data by an A/D converter 3 and further supplied to a fire predictive determining section 6. The fire predictive determining section 6 comprises a vector predictive calculating section 38 which predicts future data changes from the vector formed by n different kinds of fire data, and a vector determining section 39 which determines a fire when the predictively calculated vector data exceeds a threshold value level set in an n-dimensional space.

The principle of the fire determination according to the present embodiment will now be described.

If n kinds of the quantity of state peculiar to a fire to be detected by the analog sensors 1*a* to 1*n* are assumed as x1, x2, . . . xn, and when an n dimensional space with the quantity of state x1 to xn as an ordinate or abscissa is considered, the synthetic vector X in the dimensional space can be expressed by:

$$X=x1i1+x2i2+\ldots+xnin$$

where ii (i+1, 2, . . . n) represents a unit vector in the respective coordinate directions. If a time element t is included in the synthetic vector X, the synthetic vector X changes in the n dimensional space according to the development of the fire and the vector locus drawn by the terminal point of the synthetic vector X indicates a change in the surroundings. Thus, the conditions of the surroundings related to the fire can be expressed by the vector X(t) in the n dimensional space.

In the n dimensional space determined by the n physical changes, the danger level, i.e. a level at which it would be difficult for the human beings to exist, which is to be detected, can be set as an n dimensional closed surface. The n dimensional closed surface defining the danger level is expressed by the following formula:

$$f(x1, x2, \ldots xn)=0$$

In this case, when the terminal point of the vector X determined by the quantity of state x1 to xn passes through the closed surface, it can be supposed that the fire has reached the danger level.

If the closed surface $f(x1 \ldots xn)=0$ is a three-dimensional ellipse surface, the formula (2) can be expressed by:

$$(a1x1^2+a2x2^2+a3x3^2)-1=0$$

If the constants a1 to an are included in x1 to xn and standardized as x1 to xn, the closed surface representing the danger level may be considered as a three-dimensional spherical surface with a radius r which can be expressed by:

$$(x1^2+x2^2+x3^2)-r^2=0$$

In other words, the constants a1 to an may be changed to evaluate the analog data 1*a* to 1*n* for effecting the optimum fire detection.

After the n dimensional closed surface for determining the danger level is set, the quantities of state x1(t) to Xn(t) detected at time t are substituted for the above x1 to xn. When the condition $$f(xi(t)) \leqq 0$$

is satisfied, the terminal point of the vector X passes through the closed surface as given by the above formula and is out of the closed surface, and therefore it can be determined that the conditions of the fire exceeds the danger level.

In order to predict the future position of the n dimensional vector X linearly, the slope $(\delta X/\delta t)_t$ of the vector X(t) at the present time t0 with respect to the time t is obtained and the vector X(t) is extended along the slope so that the terminal point of the vector X after the predetermined period of time may be predicted.

More specifically, vector X(t0+ta) after ta seconds from the present time t0 can be approximated as follows:

$$X(t0+ta)=X(t0)+ta(\delta X/\delta t)_{t0}$$

The slope $(\delta X/\delta t)_t$ can be obtained by a the difference between the vector position $X(t0-\Delta t)$ at a predetermined period t of time back from the present time t0 and the vector position X(t) as follows:

$$(\delta X/\delta t)_{t0}=X(t0)-X(t0-\Delta t)/\Delta t$$

If this formula is expressed to the respective physical changes x1 to xn, the following are obtained:

$$\begin{aligned} x1(t0+ta) &= x1(t0)+ta\,(\partial x1/\partial t)_{t0} \\ &\vdots \\ xn(t0+ta) &= xn(t0)+ta\,(\partial xn/\partial t)_{t0} \end{aligned}$$

The slopes of the data provided by the respective analog sensors 1*a* to 1*n* can be expressed as follows:

$$\begin{aligned} (\partial x1/\partial t)_{t0} &= x1(t0)-x1(t0-\Delta t)/\Delta t \\ (\partial x2/\partial t)_{t0} &= x2(t0)-x2(t0-\Delta t)/\Delta t \\ &\vdots \\ (\partial xn/\partial t)_{t0} &= xn(t0)-xn(t0-\Delta t)/\Delta t \end{aligned}$$

If i=1, 2 . . . n, $$xi(t0+ta)=xi+ta(\delta xi/\delta t)_{t0}$$

$$(\delta xi/\delta t)_{t0}=xi(t0)-xi(t0-\Delta t)/\Delta t$$

If the running average data $LD1^m$, $LD2^m \ldots LDn^m$ are computed at present time $t_0$ and the quantity of state of each sensors 1*a* to 1*n* after the predetermined period ta of time can be expressed as follows:

$$\begin{aligned} x1^{m+M} &= LD1^m + M\Delta t\,(\partial x1/\partial t)_{t0} \\ x2^{m+M} &= LD2^m + M\Delta t\,(\partial x1/\partial t)_{t0} \\ &\vdots \\ xn^{m+M} &= LDn^m + M\Delta t\,(\partial xn/\partial t)_{t0} \\ (ta &= M\Delta t) \end{aligned}$$

The slopes are expressed as follows.

$$\begin{aligned} (\partial x1/\partial t)_{t0} &= LD1^m - LD1^{m-1}/\Delta t \\ (\partial x2/\partial t)_{t0} &= LD2^m - LD2^{m-1}/\Delta t \\ &\vdots \\ (\partial xn/\partial t)_{t0} &= LDn^m - LDn^{m-1}/\Delta t \end{aligned}$$

The vector predictive calculating section 38 predicts the position of the terminal point of the synthetic vector X by using the data $x1^{m+M}$, $x2^{m+M} \ldots xn^{m+M}$ after the predetermined period ta of time which have been computed as described above. More specifically, these data are substituted for the predetermined equation of the closed surface $f(x)_D$ to compute the values. If the equation is predetermined as:

$$f(x)_D=(a1(x1)^2+a2(x2)^2+\ldots+an(xn)^2)-1$$

closed surface $f(x_{m+M})_D$ of which after passing the predetermined time $t_a$ from the present time $t_0$ is computed as follows:

$$f(x_{m+M})_D=(a1(x1^{m+M})^2+a2(x2^{m+M})^2+\ldots+an(xn^{m+M})^2)-1$$

Since $xi^{m+M}$ in the above formula contains an element of time, the positions of the terminal points of the synthetic vectors X obtained by synthesizing the future values of the respective data are shown in relation with the predetermined closed surface $f(x)_D=0$.

The vector determining section 39 determines whether the terminal point of the synthetic vector X is within or being out of the closed surface $f(x)_D=0$ when $$a1(x1^{m+M})^2+a2)x2^{m+M})^2+\ldots+an(xn^{m+M})^2-1\geqq 0$$

and generates an output signal to the fire signal outputting section 11.

To approximate the position of the terminal point of the synthetic vector X to a quadratic point, the following quadratic approximation and differential coefficient may be employed.

$$X(t0+ta)=X(t0)+ta(\delta X/\delta t)_{t0}+ta^2(\delta^2X/\delta t^2)_{t0}/2$$

$$(\delta^2X/\delta t^2)_{t0}=X(t0)-2X(t0-\Delta t)+X(t0-2\Delta t)/\Delta t^2$$

The prediction of the vector can be effected in a similar manner with respect to n(third or more)-degree approximation.

Figure 13:
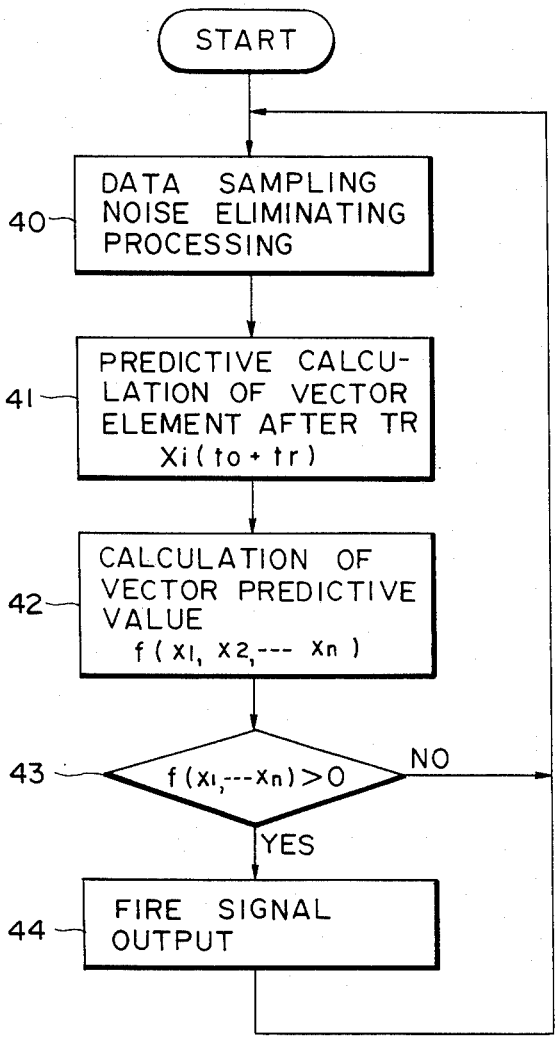
FIG. 13 is a flowchart of the fire determination processing at the fire detector of FIG. 12.

FIG. 13 is a flowchart showing the fire determination carried out by the vector predictive calculating section 38 and the vector determining section 39 of FIG. 12.

In FIG. 13, n-kinds of different analog data are sampled and then subjected to average calculation to eliminate noises at block 40, thereby to obtain different kinds of quantity of state amounts x1, x2, . . . xn characteristic in a fire for each of the sensors 1*a* to 1*n*, respectively.

Subsequently, at block 41, predictive calculation of a vector element xi(t0+tr) after time tr is carried out.

After the predictive calculation of the vector element xi(t0+tr) after the time tr from the present time t0 has been completed, the process proceeds to block 42 and vector predictive calculation is carried out to determine whether the predicted vector X(t0+tr) exceeds the closed curve surface f(x1, x2, . . . xn)=0 preliminarily set in the n-dimensional space for providing the danger level.

More specifically, the vector elements x1(t0+tr) to xn(t0+tr) after the time tr, which have been obtained at block 41 are substituted for f(x1, x2, . . . xn) to obtain the values thereof.

Then, at block 43, it is determined whether the values of f(x1, x2, . . . xn) given by the predictive vector after the time tr which has been obtained at block 42 is larger than zero or not. If the predictive vector exceeds the closed curved surface providing the danger level, the calculated value of block 42 is positive and larger than zero, whereas if the predictive vector does not reach the closed curved surface providing the danger level, the calculated value is negative and smaller than zero. Therefore, if the determination at block 43 is more than zero, it is determined that the predictive vector after the time tr reaches the closed curved surface providing the danger level and a fire signal is output at block 44.

Figure 14:
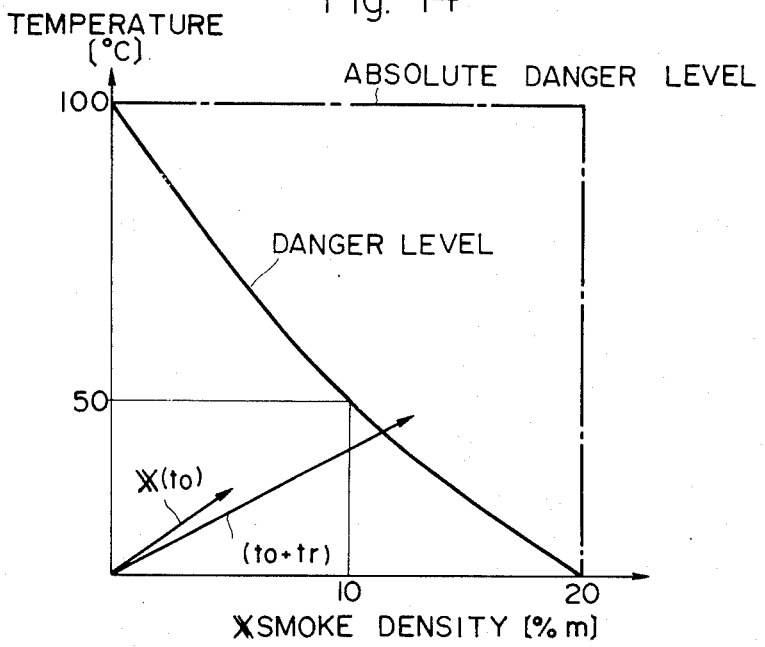
FIG. 14 is a graph for showing the fire determination of the detector of FIG. 12.

FIG. 14 is an explanatory view of coordinates showing the fire determination on the basis of predictive vector calculation to be carried out according to the flowchart of FIG. 13, in terms of two analog amounts of a temperature and a smoke density. For example, if the danger level of the temperature is assumed as 100° C. and the danger level of the smoke density is assumed as 20%m of extinction, for example a sectoral danger level D designated by a solid line is preliminarily set within an absolute danger level designated by a dotted line.

In such a two-dimensional space of the temperature and the smoke density, if the vector at the present time t0 is assumed to be X(t0), the vector X(t0+tr) after the time tr from the present time t0 is predictively calculated. If the predictively calculated vector X(t0+tr) exceeds the danger level D as illustrated, it is determined as a fire and a fire signal is output. If the vector X(t0+tr) does not reach the danger level D, a fire signal is not output and the predictive vector calculation on the basis of the succeeding sampling data is further carried out.

Although the fire determination processing is carried out by predictive calculation by the functional approximation in the foregoing embodiments, the present invention is not limited thereto and fire determination processing may alternatively be made by suitable programming of a CPU.

I claim:

1. An analog fire detector which comprises:

sensor means for detecting, in analog form, one or more kinds of quantity of state, which will change due to a fire;

sampling means for sampling the detection outputs from the sensor means with a predetermined period; and fire determining means which predicts future fire data changes from the sampling data and generates a fire determination output signal when the prediction data satisfies predetermined fire conditions.

2. An analog fire detector as claimed in claim 1, wherein said fire determining means predicts a change of the fire data by functional approximation.

3. An analog fire detector as claimed in claim 2, which further comprises a data transmission control means which inhibits transmission of the sampling data to said fire determining means when said data is lower than a predetermined value and allows transmission of said data to said fire determining means when said data exceeds said predetermined value.

4. An analog detector as claimed in claim 3, which further comprises an average calculating means for carrying out average calculation and wherein said fire determining means predicts a change of the fire data on the basis of the average calculation data.

5. An analog fire detector as claimed in claim 4, which is connected between a pair of power supply/signal lines and which further comprises a fire signal outputting section circuit adapted to produce a short-circuit between the signal lines on the basis of the output signal from the fire determining means for transmitting such signal.

6. An analog fire detector as claimed in claim 5, which further comprises a unique signal transmitting section for transmitting, through the signal lines, a unique signal having a frequency preliminarily allotted or an address signal when the fire signal outputting section produces an output signal.

7. An analog fire detector as claimed in claim 3, in which a calculation starting level is provided for the fire determination carried out by the fire determining means.

8. An analog fire detector as claimed in claim 3, in which the predetermined value of the sampling data is a sensor threshold level which provides noise reduction.

9. An analog fire detector as claimed in claim 3, in which a calculation starting level is provided for the fire determination carried out by the fire determining means and the predetermined value of the sampling data is a sensor threshold level which provides noise reduction.

10. An analog fire detector as claimed in claim 9, which further comprises an average calculating means for carrying out average calculation and wherein said fire determining means predicts a change of the fire data on the basis of the average calculation data.

11. An analog fire detector as claimed in claim 10, which is connected between a pair of power supply/signal lines and which further comprises a fire signal outputting section circuit adapted to produce a short-circuit between the signal lines on the basis of the output signal from the fire determining means for transmitting such signal.

12. An analog fire detector as claimed in claim 11, which further comprises a unique signal transmitting section for transmitting, through the signal lines, a unique signal having a frequency preliminarily allotted or an address signal when the fire signal outputting section produces an output signal.

13. An analog fire detector as claimed in claim 2, wherein said fire determining means further comprises a vector predictive calculating section for predicting future fire data from the vector formed by a plurality of kinds of sampling data and a vector determining section adapted to generate a fire determination output when the predicted vector data exceeds a predetermined level preliminarily set in a given dimensional vector space.

14. A fire alarm system which comprises:

a central signal station; and a plurality of analog fire detectors connected to a pair of power supply/signal lines connected to said central signal station;

said analog fire detectors each comprising sensor means for detecting, in analog form, one or more kinds of quantity of state which change due to a fire;

sampling means for sampling the detection outputs from the sensor means with a predetermined period; and fire determining means which predicts future fire data changes from the sampling data and generates a fire determination output when the prediction data satisfies predetermined fire conditions.

15. A fire alarm system which comprises:

a central signal station;

a plurality of on-off type fire detectors connected to a pair of power supply/signal lines derived from said central signal station in such a manner that the signal lines are short-circuited into low impedance when the value of a quantity of state which changes due to a fire exceeds a threshold value; and an intelligent fire detector installed in specific areas where the signal lines are extended, such as an important supervisory area or an area where a false alarming is liable to occur, and adapted to short-circuit said lines into low impedance when a predicted value of a future quantity of state changing due to a fire satisfies predetermined fire conditions;

said intelligent fire detector including one or more sensor means for detecting, in analog form, one or more kinds of quantity of state which will change due to a fire; sampling means for sampling the detection outputs from the sensor means with a predetermined period; fire determining means which predicts future fire data changes from the sampling data and generates a fire determination output signal when the prediction data satisfies predetermined fire conditions; and a fire signal outputting section for short-circuiting said power supply/signal lines into low impedance on the basis of the fire determination output signal.

16. A fire alarm system as claimed in claim 15, wherein said fire determining means of the intelligent fire detector predicts a change of fire data by the functional approximation.

17. A fire alarm system as claimed in claim 16, wherein said intelligent fire detector further comprises a data transmission control means which inhibits transmission of the sampling data to said fire determining means when said data is lower than a predetermined value and allows transmission of said data to said fire determining means when said data exceeds said predetermined value.

18. An analog fire detector as claimed in claim 17, in which a calculation starting level is provided for the fire determination carried out by the fire determining means.

19. An analog fire detector as claimed in claim 17, in which the predetermined value of the sampling data is a sensor threshold level which being defined for noise reduction.

20. An analog fire detector as claimed in claim 17, in which a calculation starting level is provided for the fire determination carried out by the fire determining means and the predetermined value of the sampling data is a sensor threshold level which provides noise reduction.

21. A fire alarm system as claimed in claim 20, wherein said intelligent fire detector further comprises an average calculating means for carrying out average calculation and wherein said fire determining means predicts a change of the fire data on the basis of the average calculation data.

22. A fire alarm system as claimed in claim 16, wherein said fire determining means of said intelligent fire detector further comprises a vector predictive calculating section for predicting future fire data from the vector formed by the plurality of kinds of sampling data and a vector determining section adapted to generate a fire determination output when the predicted vector data exceeds a predetermined level preliminarily set in a given dimensional vector space.

* * * * *